US010526741B2

(12) United States Patent
Bae et al.

(10) Patent No.: US 10,526,741 B2
(45) Date of Patent: Jan. 7, 2020

(54) WASHING MACHINE

(71) Applicant: Samsung Electronics Co., Ltd, Gyeonggi-do (KR)

(72) Inventors: Il Sung Bae, Gyeongg-do (KR); In Ju Lee, Gyeonggi-do (KR); Doo Young Ryu, Gyeonggi-do (KR); Jae Seuk Park, Gyeonggi-do (KR); Jeoung Kyo Jeoung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 363 days.

(21) Appl. No.: 15/116,817

(22) PCT Filed: Feb. 2, 2015

(86) PCT No.: PCT/KR2015/001062

§ 371 (c)(1),
(2) Date: Aug. 4, 2016

(87) PCT Pub. No.: WO2015/119404

PCT Pub. Date: Aug. 13, 2015

(65) Prior Publication Data

US 2016/0348295 A1 Dec. 1, 2016

(30) Foreign Application Priority Data

Feb. 4, 2014 (KR) ..... 10-2014-0012671
Dec. 18, 2014 (KR) ..... 10-2014-0183608

(51) Int. Cl.
*D06F 37/20* (2006.01)
*D06F 37/22* (2006.01)
*D06F 37/04* (2006.01)

(52) U.S. Cl.
CPC ..... *D06F 37/203* (2013.01); *D06F 37/225* (2013.01); *D06F 37/04* (2013.01)

(58) Field of Classification Search
CPC ..... D06F 37/203; D06F 37/225; D06F 37/04
See application file for complete search history.

(56) References Cited

U.S. PATENT DOCUMENTS 5,626,038 A 5/1997 Hong
2013/0031938 A1 2/2013 Cho et al.
(Continued)

FOREIGN PATENT DOCUMENTS

CN 101681694 A 3/2010
CN 102912593 A 2/2013
(Continued)

OTHER PUBLICATIONS

International Search Report dated May 7, 2015 in connection with International Application No. PCT/KR2015/001062, 3 pages.
(Continued)

*Primary Examiner* — Benjamin L Osterhout

(57) ABSTRACT

Disclosed herein is a washing machine including a balancer module which is actively driven in a balancer housing to damp load unbalance of the washing machine, a power supplying unit provided at an outside of a tub to supply electric power to the balancer module, and a wire configured to pass through a hollow portion of a rotating shaft of a flange shaft to electrically connect the balancer module and the power supplying unit. The washing machine comprises a slip ring disposed between the rotating balancer module and the fixed power supplying unit to prevent the wire from being twisted. An internal wire disposed in a rotating tub is covered by a waterproofing tube so as to prevent moisture from permeating the internal wire. The hollow portion of the rotating shaft of the flange shaft is sealed by a stopper member and a packing member so as to prevent the moisture from permeating. An external wire disposed at an outside of the tub may be neatly arranged by a guide bracket.

20 Claims, 15 Drawing Sheets

(56) References Cited

U.S. PATENT DOCUMENTS

| | | | | |
|---|---|---|---|---|
| 2013/0327098 | A1 | 12/2013 | Bae et al. | |
| 2013/0327099 | A1* | 12/2013 | Bae | F16F 7/1011 68/13 R |
| 2014/0101864 | A1* | 4/2014 | Lee | D06F 33/02 8/137 |

FOREIGN PATENT DOCUMENTS

| | | | |
|---|---|---|---|
| CN | 103485126 | A | 1/2014 |
| KR | 10-2010-0007960 | | 1/2010 |
| KR | 10-1096929 | B1 | 1/2014 |
| WO | WO 02/40761 | A1 | 5/2002 |

OTHER PUBLICATIONS

Written Opinion of the International Searching Authority dated May 7, 2015 in connection with International Application No. PCT/KR2015/001062, 12 pages.

State Intellectual Property Office of the People's Republic of China, The First Office Action, Chinese Application No. 201580007083.X, dated Jan. 25, 2018, 21 pages.

Decision on Grant dated Jul. 25, 2018 in connection with Chinese Patent Application No. 201580007083.X, 5 pages.

* cited by examiner

[Fig. 1]
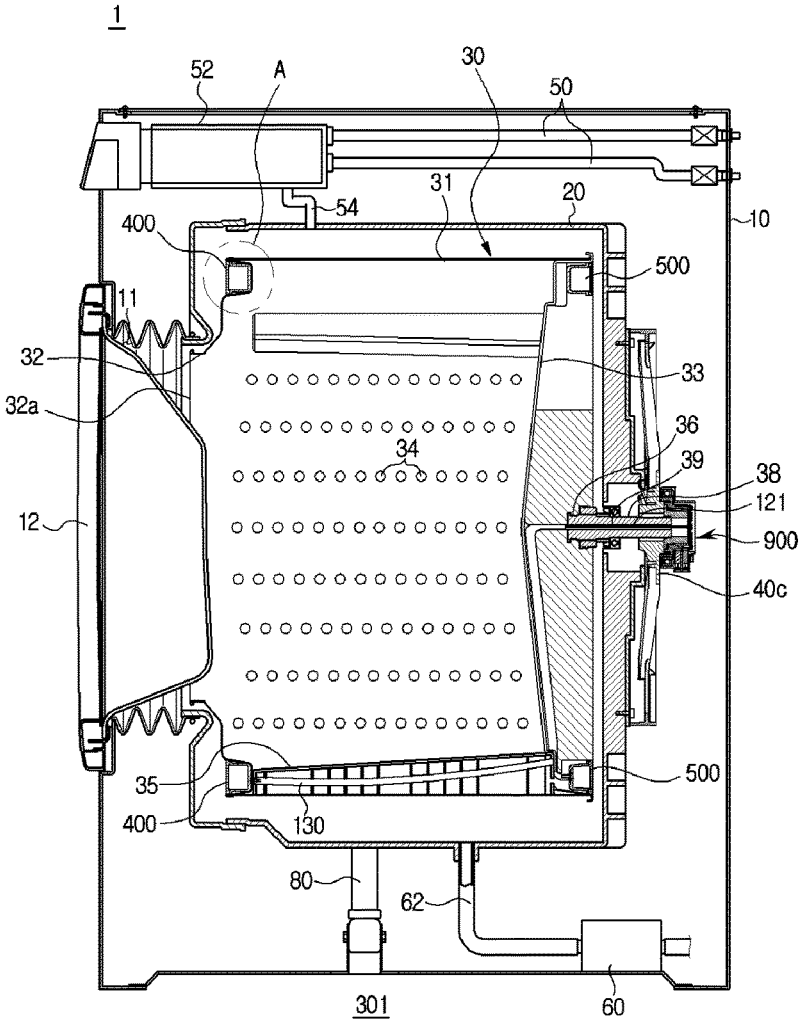

[Fig. 2]
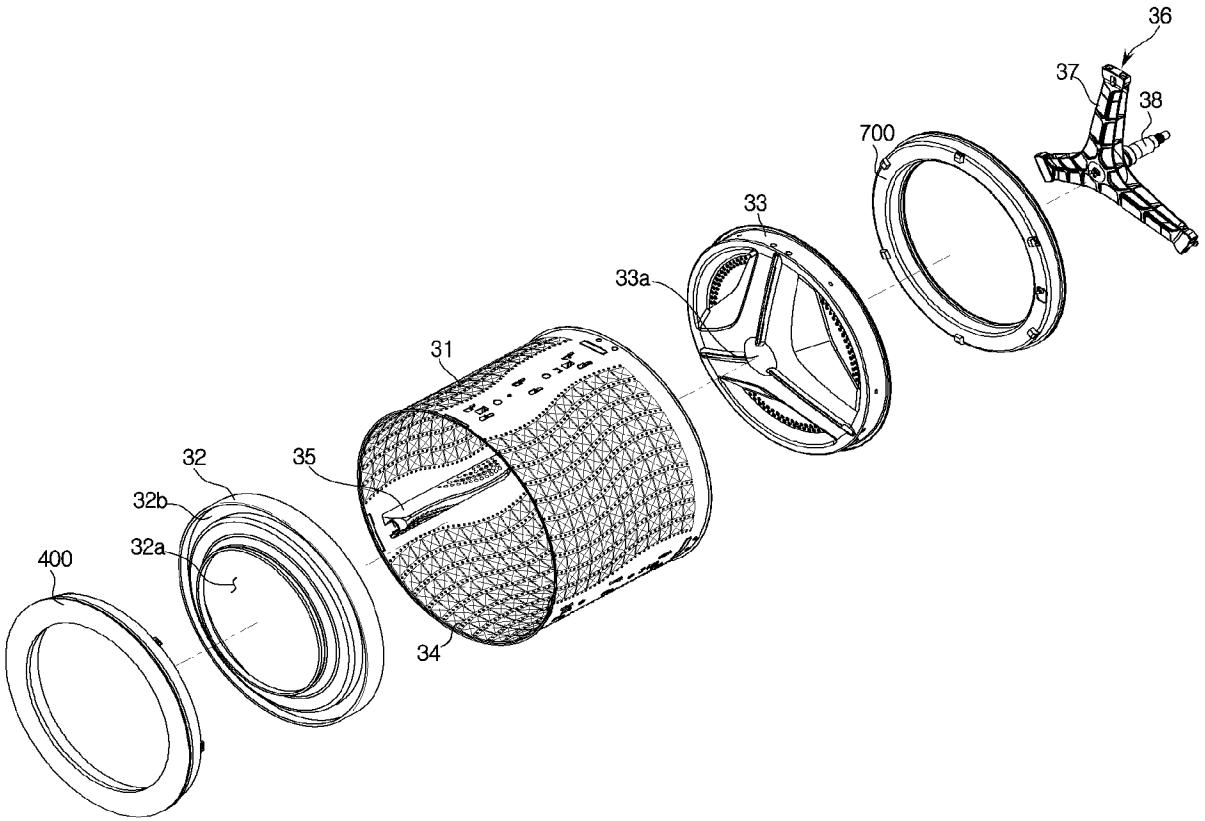

[Fig. 3]
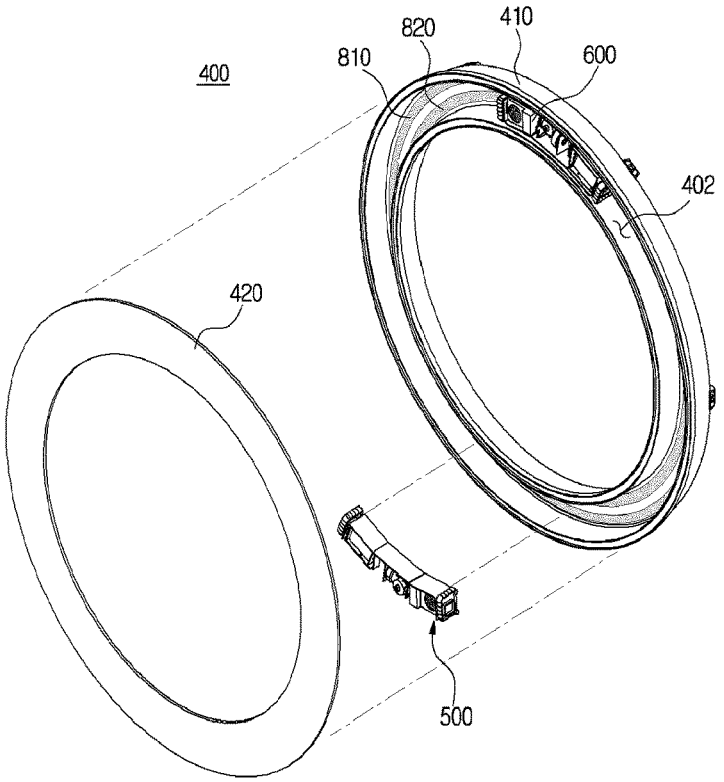
[Fig. 4]
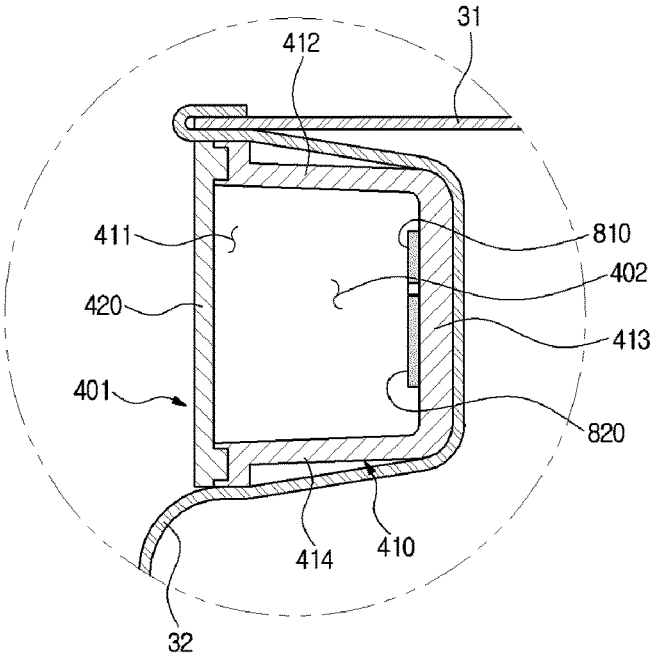

[Fig. 5]
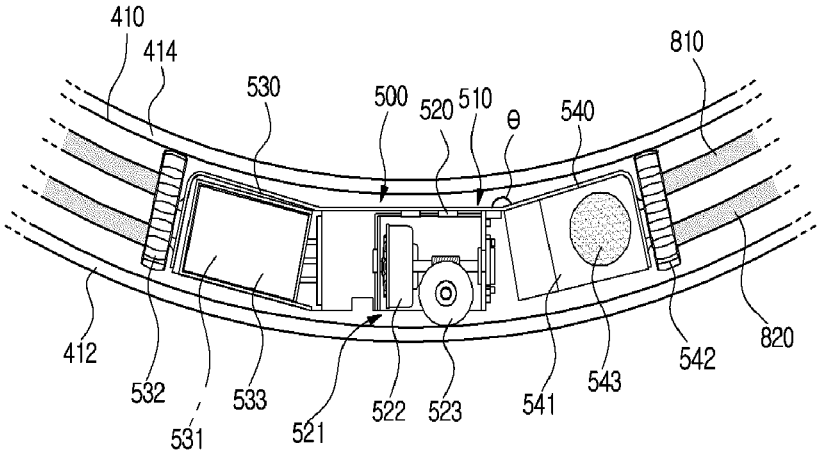
[Fig. 6]
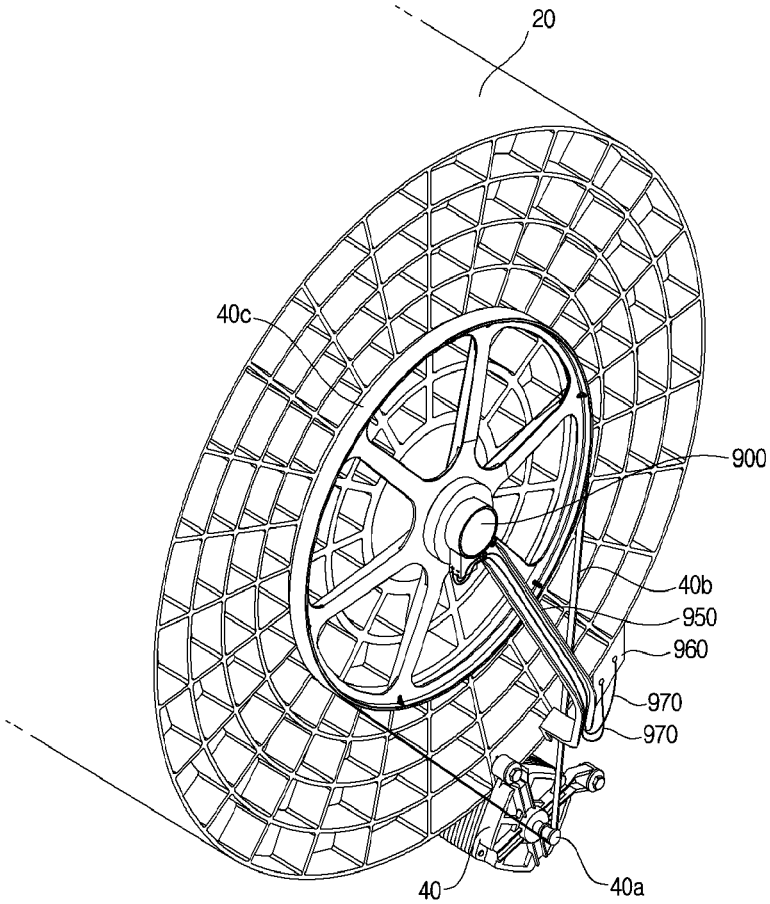

[Fig. 7]
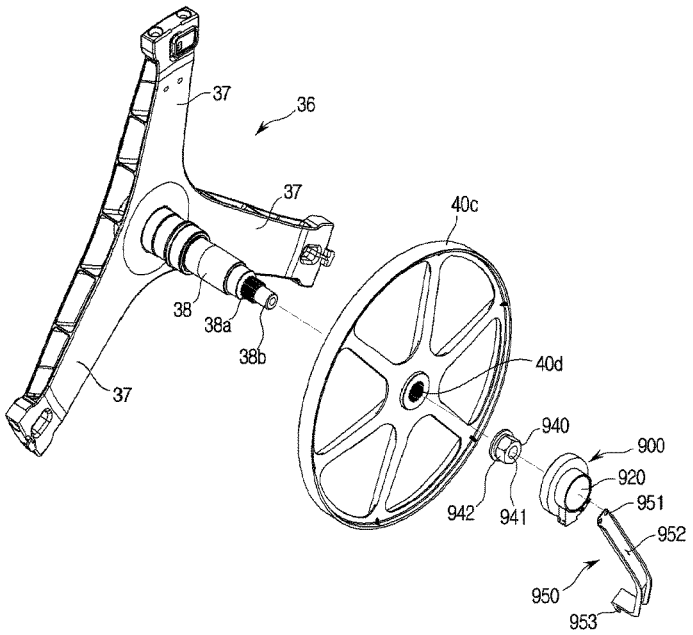
[Fig. 8]
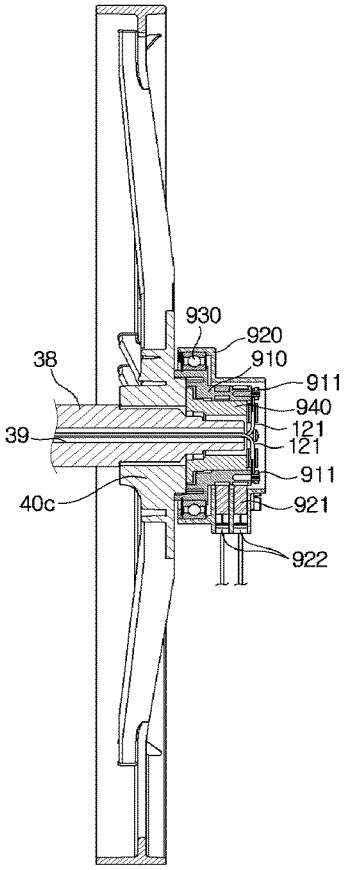

[Fig. 9]
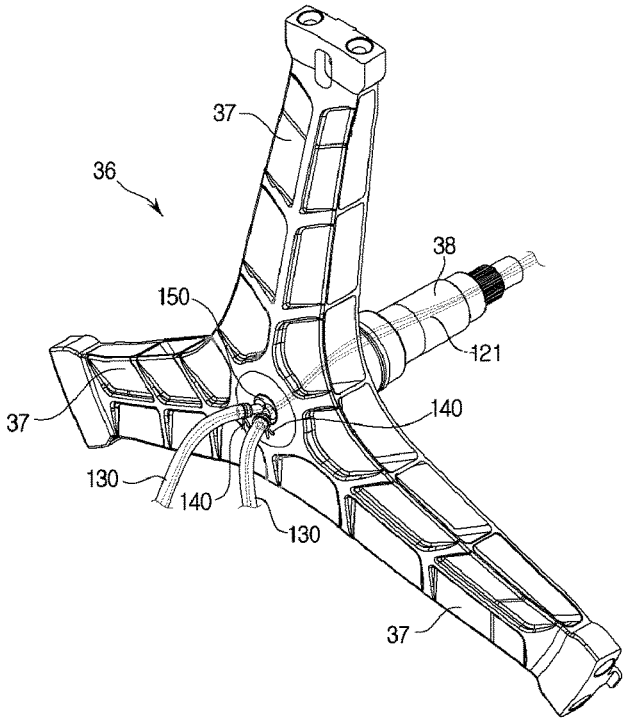
[Fig. 10]
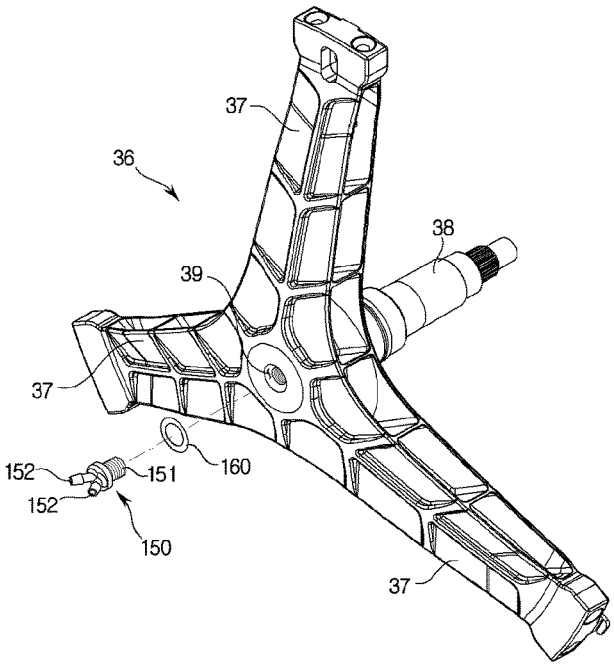

[Fig. 11]
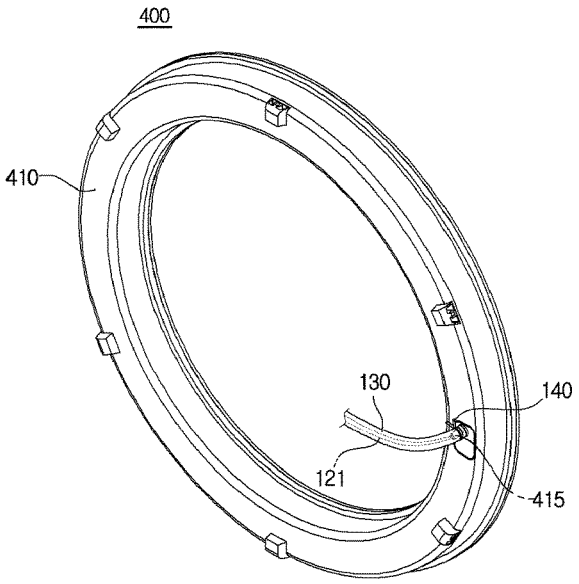
[Fig. 12]
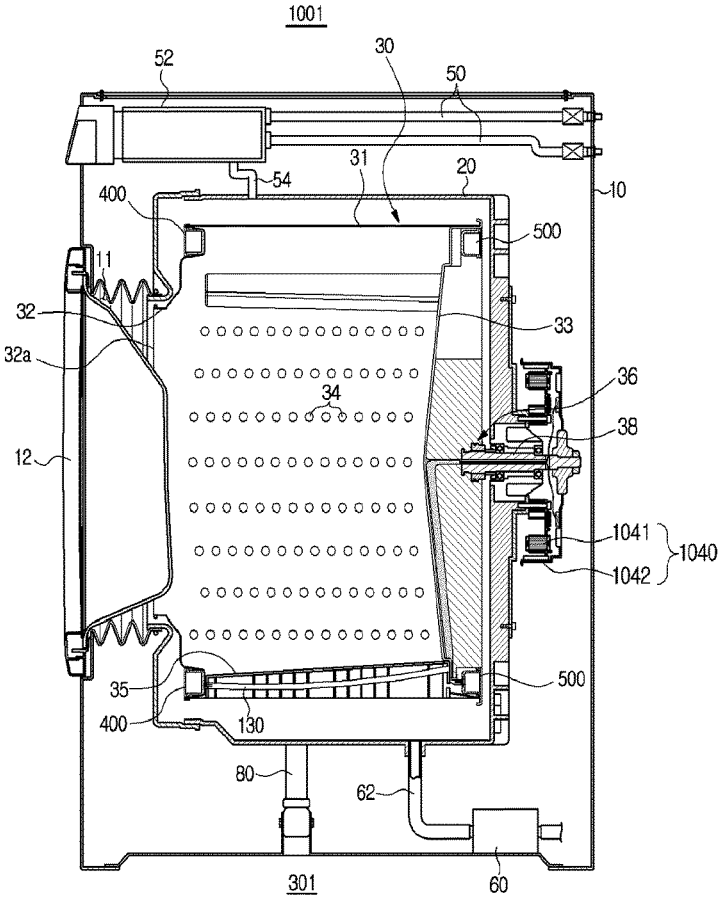

[Fig. 13]
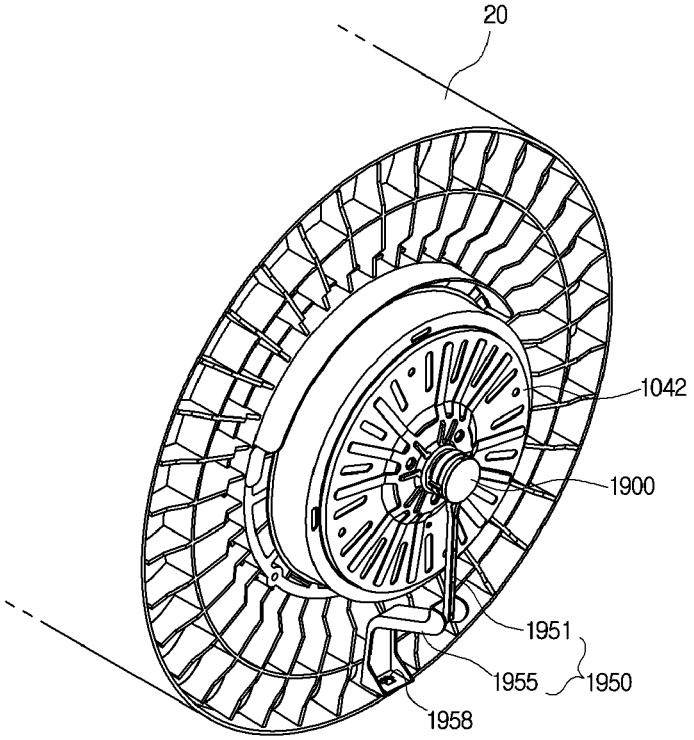

[Fig. 14]
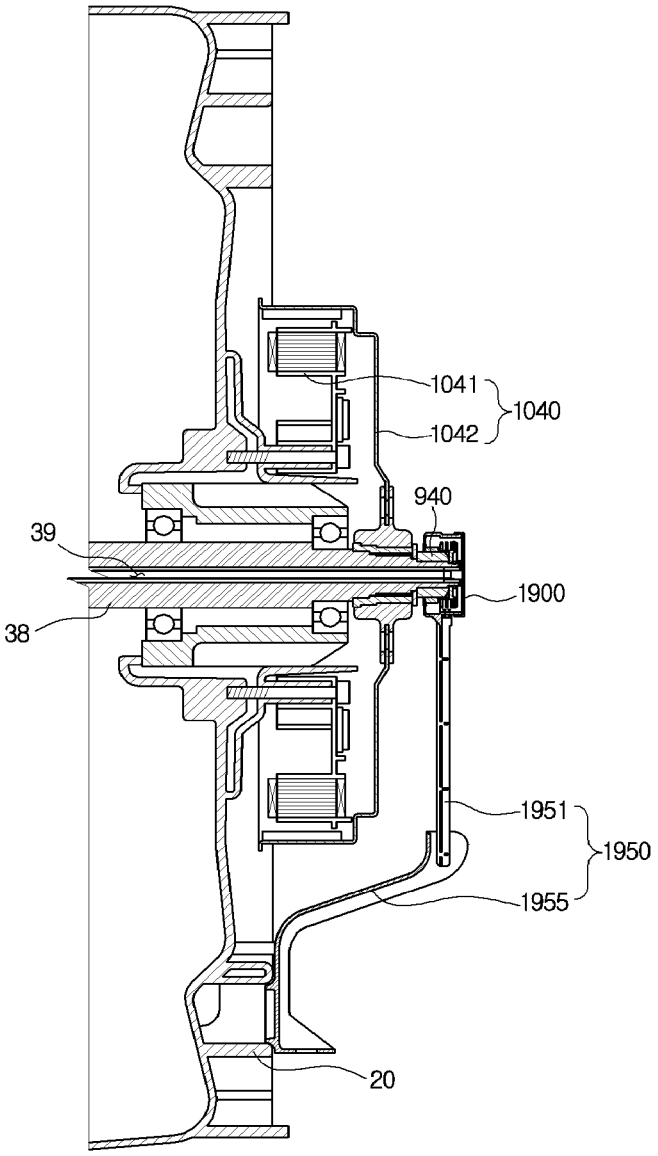

[Fig. 15]
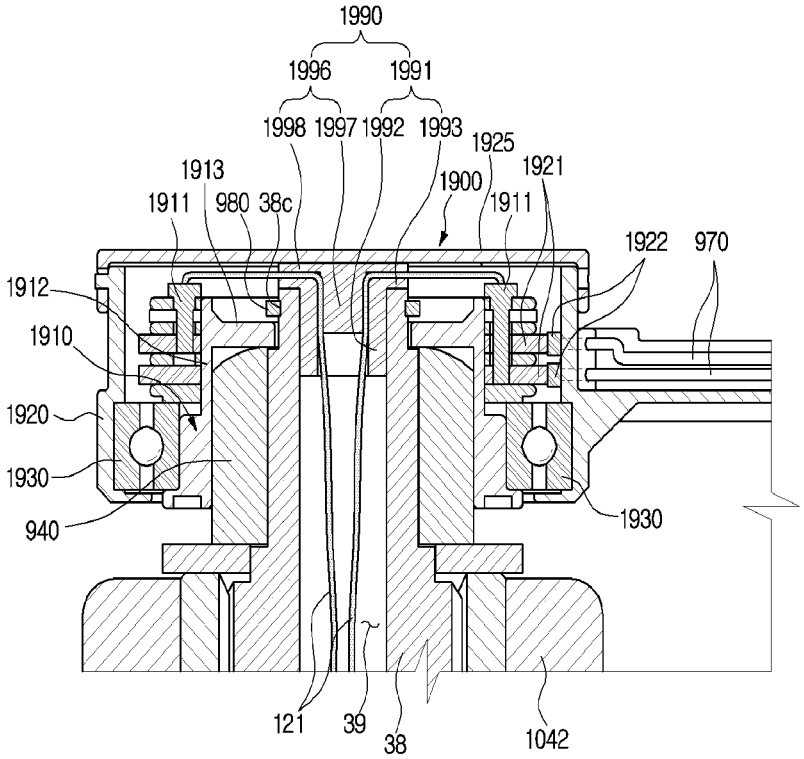

[Fig. 16]
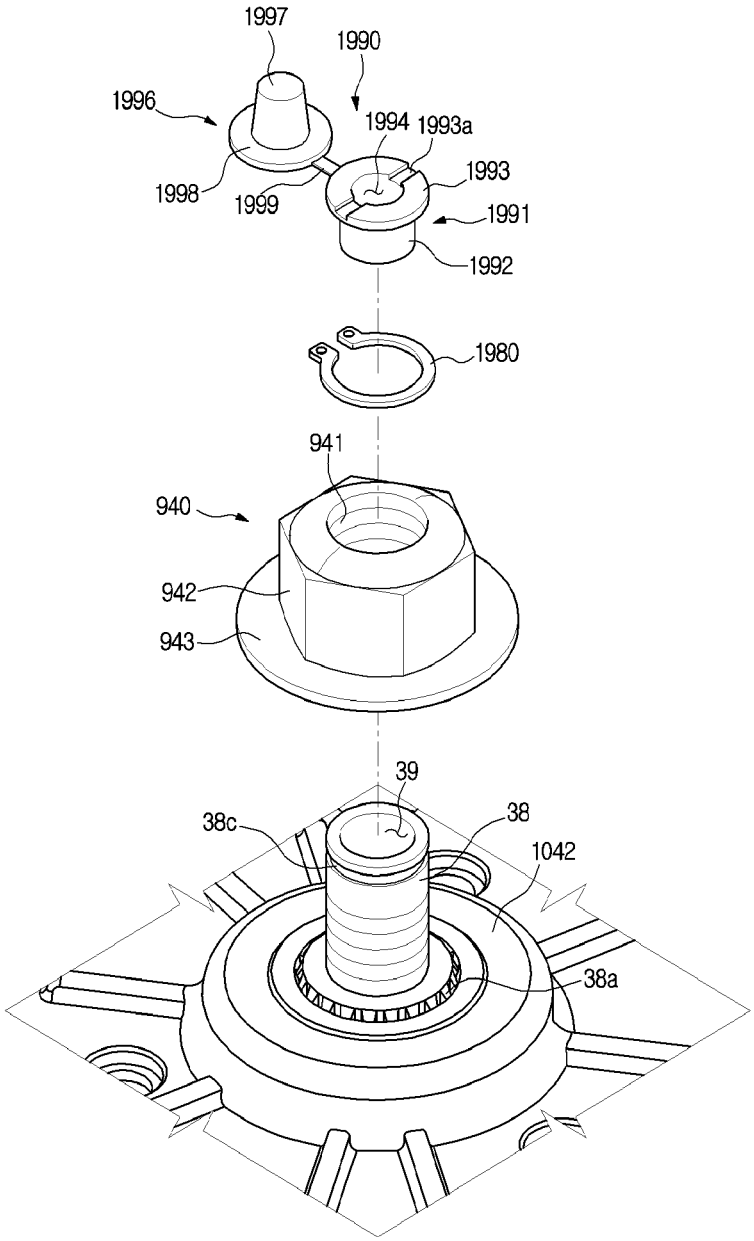

[Fig. 17]
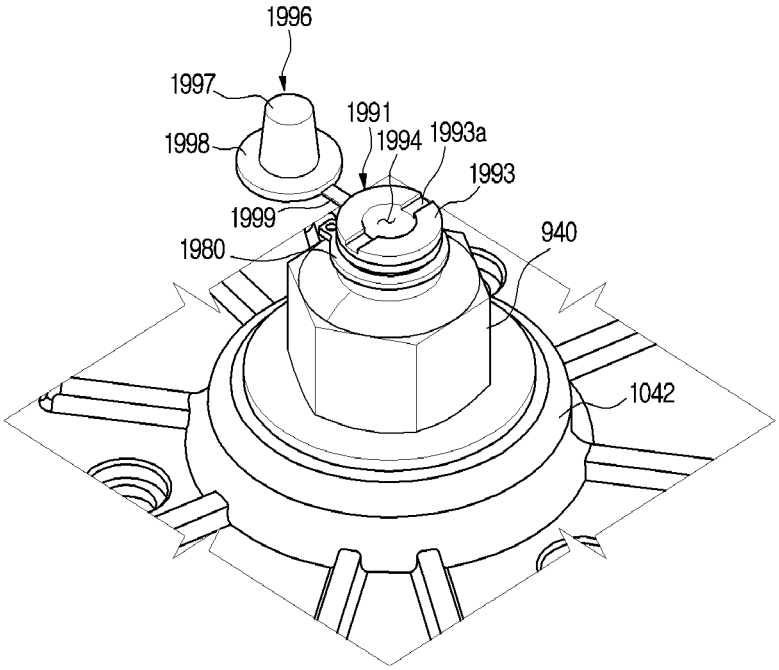
[Fig. 18]
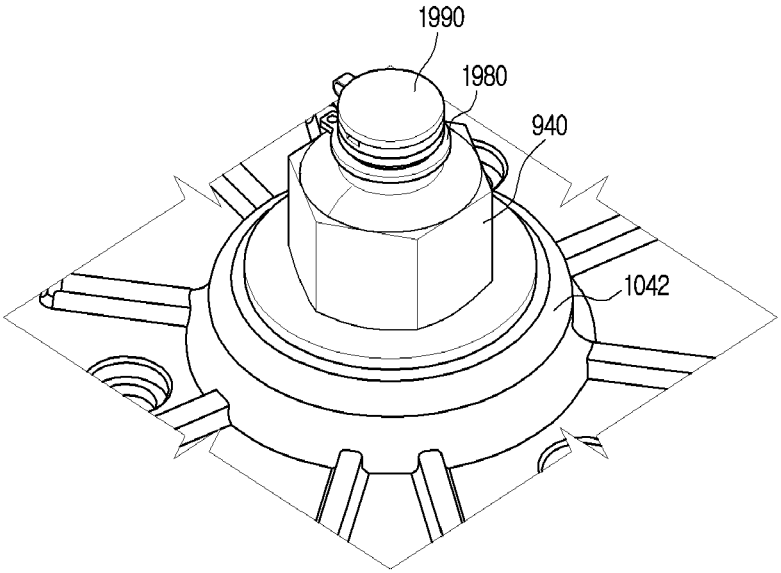

[Fig. 19]
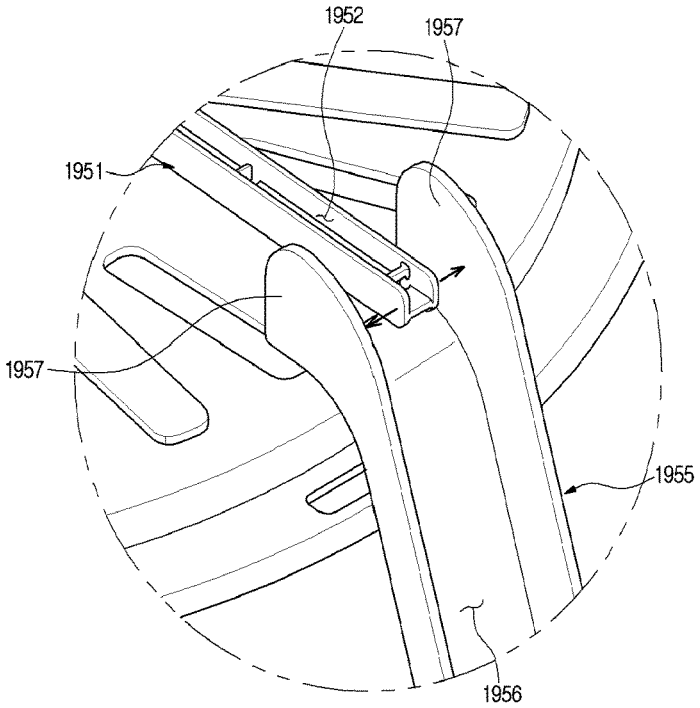
[Fig. 20]
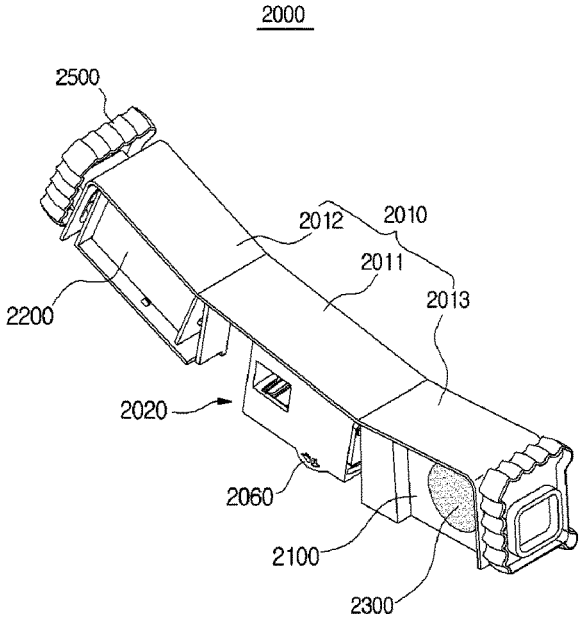

[Fig. 21]
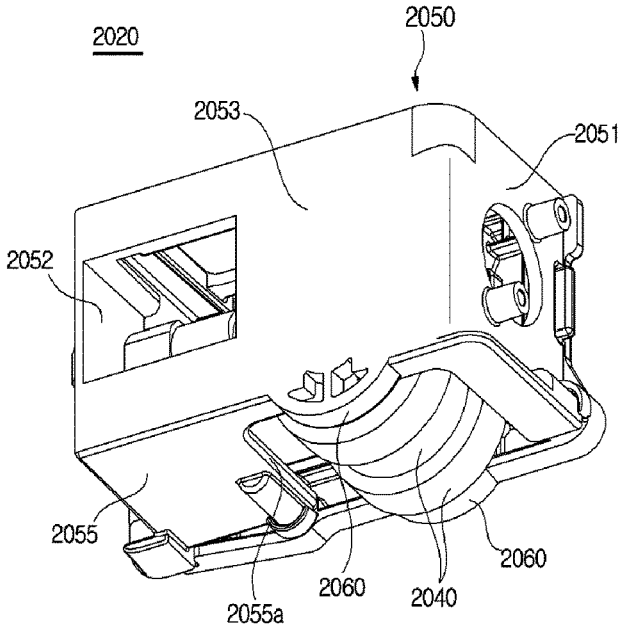
[Fig. 22]
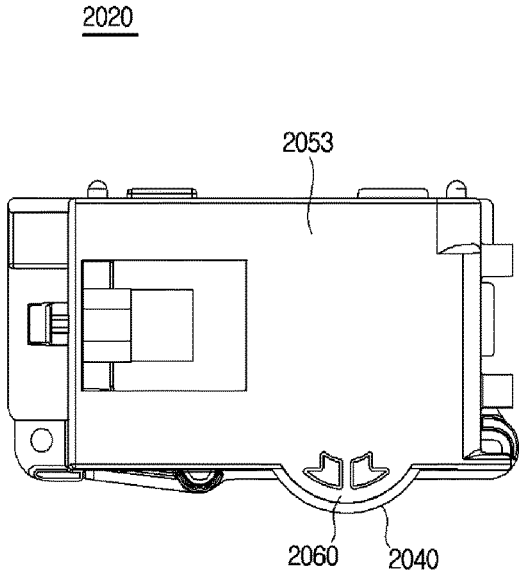

[Fig. 23]
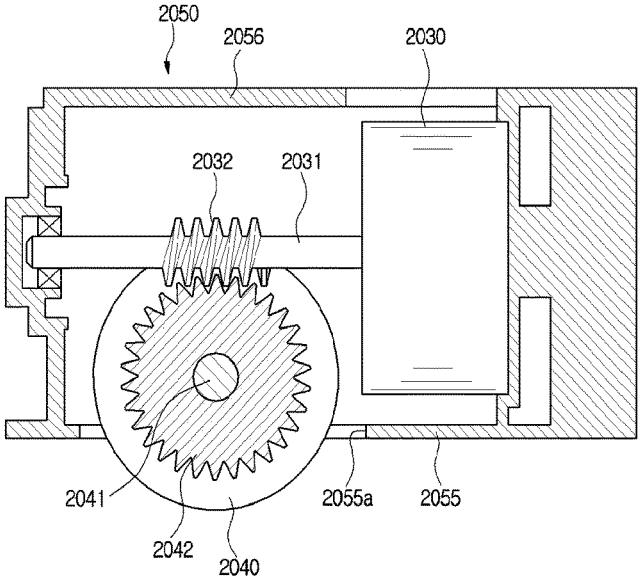
[Fig. 24]
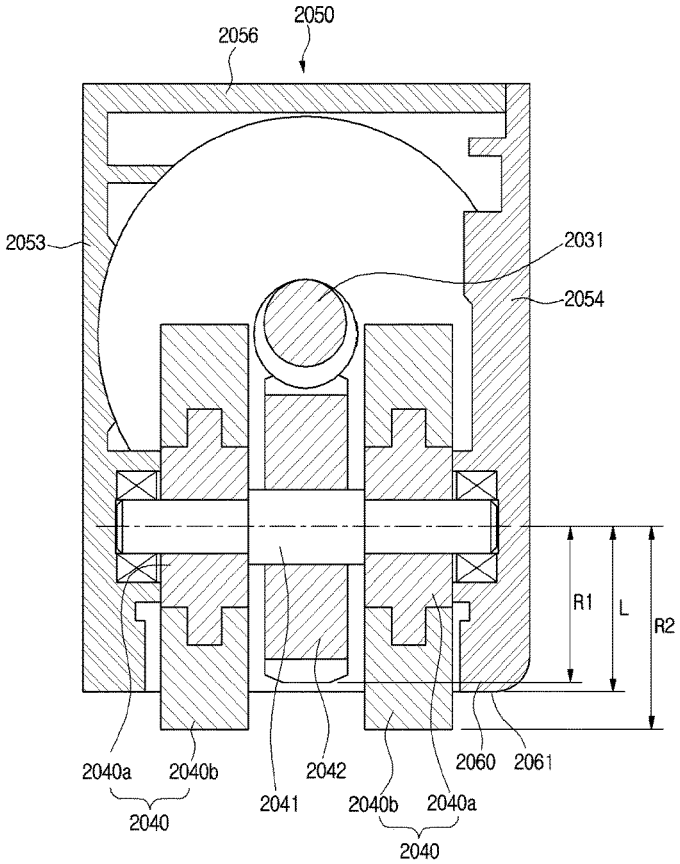

WASHING MACHINE

CROSS-REFERENCE TO RELATED APPLICATIONS AND CLAIMS OF PRIORITY

The present application claims priority under 35 U.S.C. § 365 to International Patent Application No. PCT/KR2015/001062 filed Feb. 2, 2015, entitled "WASHING MACHINE", and, through International Patent Application No. PCT/KR2015/001062, to Korean Patent Application No. 10-2014-0012671 filed Feb. 4, 2014, each of which are incorporated herein by reference into the present disclosures as if fully set forth herein.

TECHNICAL FIELD

The present invention relates to a washing machine which has an active balancer to damp load unbalance, and more particularly, to a waterproofing and protecting structure of a wire which supplies power to the active balancer, and a slip ring structure which prevents a twist of the wire.

BACKGROUND ART

In general, a washing machine is an apparatus which washes laundry using electric power, and includes a tub which stores wash water, a rotating tub which is rotatably installed in the tub, and a motor which drives the rotating tub to be rotated. A series of washing processes such as washing, rinsing, and spin-drying are performed using a rotating motion of the rotating tub.

When the rotating tub is rotated, if the laundry is not uniformly distributed in the rotating tub and is crowded to a certain portion, vibration and noise are generated by a rotation of the rotating tub. In a severe case, components such as the rotating tub and the motor may be damaged. Therefore, the washing machine has a balancer which damps load unbalance generated in the rotating tub and stabilizes the rotation of the rotating tub.

However, in the prior art, a movement of the balancer is passively performed, and the balancer may not be precisely located at a position which damps an unbalanced load of the rotating tub, and thus the vibration and the noise may not be minimized. To solve this problem, an active balancer which receives power from an outside to be driven actively has been studied.

DISCLOSURE OF INVENTION

Technical Problem

The present invention is directed to providing a washing machine having a waterproofing and protecting structure of a wire which supplies power to an active balancer.

The present invention is also directed to providing a slip ring structure which prevents a twist of the wire and minimizes a reduction in a volume of the washing machine.

Solution to Problem

One aspect of the present invention provides a washing machine including a cabinet; a rotating tub disposed in the cabinet to accommodate laundry; a flange shaft coupled to a rear surface of the rotating tub to transmit a driving force to the rotating tub and including a flange shaft having a rotating shaft in which a hollow portion is formed; at least one balancer housing having an annular channel formed therein and installed at the rotating tub; at least one balancer module movably disposed in the channel of the at least one balancer housing to damp load unbalance when the rotating tub is rotated; a wire configured to pass through the hollow portion of the flange shaft to supply electric power to the at least one balancer module and connected with the at least one balancer housing; and a waterproofing tube provided between the flange shaft and the at least one balancer housing to prevent wash water from permeating the wire and to sealingly accommodate the wire.

The washing machine may further include a stopper member coupled into the hollow portion of the flange shaft so that one end of the waterproofing tube is coupled thereto.

The stopper member may include a shaft coupling part configured to protrude so as to be inserted into the hollow portion of the flange shaft, and at least one tube coupling part configured so that the one end of the waterproofing tube is coupled thereto.

A male screw may be formed at an outer circumferential surface of the shaft coupling part, and a female screw screwed to the male screw may be formed at the hollow portion of the flange shaft.

The washing machine may further include a sealing member provided between the stopper member and the flange shaft to seal the stopper member and the hollow portion of the flange shaft.

The washing machine may further include a clip member provided to bind the waterproofing tube so that the tube coupling part of the stopper member and the waterproofing tube are in close contact with each other.

A stopper member accommodating part configured to accommodate the stopper member may be formed at a rear plate of the rotating tub.

The at least one balancer housing may include a tube coupling part which protrudes so that one end of the waterproofing tube is coupled thereto.

The washing machine may further include a clip member provided to bind the waterproofing tube so that the tube coupling part of the at least one balancer housing and the waterproofing tube are in close contact with each other.

The rotating tub may include a lifter provided at an inner circumferential surface thereof to move up the laundry, and the waterproofing tube may be disposed to pass through the lifter.

Another aspect of the present invention provides a washing machine including a cabinet; a rotating tub disposed in the cabinet to accommodate laundry; a flange shaft coupled to a rear surface of the rotating tub to transmit a driving force to the rotating tub and including a flange shaft having a rotating shaft in which a hollow portion is formed; at least one balancer housing having an annular channel formed therein and installed at the rotating tub; at least one balancer module movably disposed in the channel of the at least one balancer housing to damp load unbalance when the rotating tub is rotated; a power supplying unit configured to generate electric power for driving the at least one balancer module; a wire configured to pass through the rotating shaft of the flange shaft to supply the electric power to the at least one balancer module and configured to electrically connect the power supplying unit and the at least one balancer housing; and a slip ring provided at an end of the rotating shaft of the flange shaft to prevent the wire from being twisted by rotation of the rotating tub.

The washing machine may further include a power transmission unit coupled to the flange shaft so as to transmit the driving force to the flange shaft, and a fastening member coupled to an end of the flange shaft to support the power transmission unit, and the slip ring may be coupled to an outside of the fastening member.

The power transmission unit may include a rotor of a motor which generates the driving force for driving the rotating tub.

The power transmission unit may include a pulley connected with a motor, which generates the driving force for driving the rotating tub, so as to be rotated.

The slip ring may include a body part to which an external wire connected with the power supplying unit is connected, and a rotating part to which an internal wire connected with the balancer housing is connected and which is rotated with the flange shaft.

The washing machine may further include a clamp ring coupled to the rotating shaft of the flange shaft to prevent the slip ring from being separated from the rotating shaft of the flange shaft.

A clamp groove may be formed at an outer circumferential surface of the rotating shaft of the flange shaft so that the clamp ring is coupled therein.

The washing machine may further include a packing member coupled to the rotating shaft of the flange shaft to seal the hollow portion of the rotating shaft of the flange shaft and thus to prevent moisture from permeating the hollow portion of the rotating shaft of the flange shaft.

The packing member may include a female packing part inserted into and in close contact with the hollow portion of the rotating shaft of the flange shaft, and a male packing part inserted into and in close contact with the female packing part.

The female packing part may include a packing body portion having a hollow portion, and a packing flange portion configured to extend from the packing body portion toward an outside in a radial direction, and the male packing part may include a packing insertion portion inserted into and in close contact with the hollow portion of the packing body portion, and a packing cover portion configured to extend from the packing insertion portion toward an outside in a radial direction so as to be in close contact with the packing flange portion.

A guide groove configured to guide the wire may be formed at the packing flange portion of the female packing part.

The packing member may include a connection strip part configured to connect the female packing part and the male packing part.

The washing machine may further include a guide bracket configured to connect the slip ring with the tub or the cabinet so as to guide the external wire and to restrict a movement of the slip ring.

The guide bracket may include a first coupling part formed at one end thereof to be coupled with the body part of the slip ring, a second coupling part formed at the other end thereof to be coupled with the tub or the cabinet, and a wire path configured to accommodate the external wire.

The guide bracket may include a first bracket coupled to the body part of the slip ring, and a second bracket coupled to the tub or the cabinet and separated from the first bracket.

The second bracket may include a rotation preventing wall interfered with the first bracket so as to restrict a rotating range of the first bracket when the rotating tub is rotated.

Still another aspect of the present invention provides a washing machine including a cabinet; a rotating tub disposed in the cabinet to accommodate laundry; at least one balancer housing having an annular channel formed therein and installed at the rotating tub; and at least one balancer module movably disposed in the channel of the at least one balancer housing to damp load unbalance when the rotating tub is rotated, wherein the balancer module includes a main plate having a central plate and one pair of side plates formed at both sides of the central plate to be bent at a predetermined angle; a mass body installed at each of the pair of side plates; and a driving part installed at the central plate to drive the balancer module, and the driving part includes a motor configured to generate a driving force; a driving wheel grounded to the balancer housing to be rotated; a transmission gear fixed to a rotating shaft of the driving wheel to transmit the driving force of the motor to the driving wheel; and a contact preventing part configured to deform and compress the driving wheel while the balancer module is driven, such that the transmission gear is prevented from being in contact with the balancer housing.

The contact preventing part may include a contact surface in contact with the balancer housing, when the driving wheel is deformed and compressed while the balancer module is driven, and a distance between the contact surface and the rotating shaft of the driving wheel may be formed to be greater than a radius of the transmission gear and to be smaller than a radius of the driving wheel.

A worm may be formed at a rotating shaft of the motor, and the rotating shaft of the driving wheel may be provided vertically to the rotating shaft of the motor, and the transmission gear may include a worm wheel engaged with the worm.

The contact preventing part may have an arc shape which protrudes toward an external wall of the balancer housing.

The driving part may include a driving part housing in which the motor is installed, and the driving part housing may include the contact preventing part.

The driving wheel may include an inner wheel provided at an inside in a radial direction and fixed to the rotating shaft of the driving wheel, and an outer wheel coupled to an outside in the radial direction of the inner wheel to be grounded to the balancer housing and to have elasticity.

Advantageous Effects of Invention

According to the spirit of the present invention, since the wire supplying the power from an external power source to the active balancer is sealed with a waterproofing tube, it is possible to prevent the wash water from permeating and also to prevent a sheath of the wire from being damaged due to an external contact.

According to the spirit of the present invention, the external water of the tub is prevented from permeating the hollow portion of the hollow shaft of the flange shaft.

According to the spirit of the present invention, since the slip ring has a shorter axial length than a conventional slip ring, it is possible to minimize the reduction in the volume of the rotating tub due to the installation of the slip ring.

BRIEF DESCRIPTION OF DRAWINGS

FIG. 1 is a view schematically illustrating a structure of a washing machine in accordance with a first embodiment of the present invention.

FIG. 2 is an exploded view of a structure of a rotating tub of the washing machine of FIG. 1.

FIG. 3 is a view illustrating a structure of a front balancer of the washing machine of FIG. 1.

FIG. 4 is a cross-sectional view of the front balancer of the washing machine of FIG. 1, in which an A portion of FIG. 1 is enlarged.

FIG. 5 is a view for describing a structure of a balancer module of the washing machine of FIG. 1.

FIG. 6 is a view illustrating a lower surface of a tub of the washing machine of FIG. 1.

FIG. 7 is a view for describing a coupling relationship of a slip ring of the washing machine of FIG. 1.

FIG. 8 is a cross-sectional view illustrating the slip ring of the washing machine of FIG. 1.

FIG. 9 is a view illustrating a waterproofing structure of a waterproofing tube and a flange shaft of the washing machine of FIG. 1.

FIG. 10 is a view illustrating a stopper member and the flange shaft of the washing machine of FIG. 1.

FIG. 11 is a view illustrating a waterproofing structure of the waterproofing tube and a balancer of the washing machine of FIG. 1.

FIG. 12 is a view schematically illustrating a structure of a washing machine in accordance with a second embodiment of the present invention.

FIG. 13 is a perspective view of a lower surface of a tub of the washing machine of FIG. 12.

FIG. 14 is a cross-sectional view illustrating a coupling structure of a flange shaft, a slip ring, and a guide bracket of the washing machine of FIG. 12.

FIG. 15 is a cross-sectional view enlargedly illustrating the coupling structure of the flange shaft and the slip ring of the washing machine of FIG. 12.

FIG. 16 is an exploded view illustrating a packing member, a clamp ring, and a fastening member coupled to the flange shaft of the washing machine of FIG. 12 (wherein the slip ring is omitted).

FIG. 17 is a view illustrating the packing member sealing a hollow portion of the flange shaft of the washing machine of FIG. 12, in which the packing member is in an opened state (wherein the slip ring is omitted).

FIG. 18 is a view illustrating the packing member sealing the hollow portion of the flange shaft of the washing machine of FIG. 12, in which the packing member is in a closed state (wherein the slip ring is omitted).

FIG. 19 is an enlarged view illustrating a spacing structure of the guide bracket of the washing machine of FIG. 12.

FIG. 20 is a view illustrating a balancer module in accordance with another embodiment of the present invention.

FIG. 21 is a bottom perspective view of a driving part of the balancer module of FIG. 20.

FIG. 22 is a side view of the driving part of the balancer module of FIG. 20.

FIG. 23 is a side cross-sectional view of the driving part of the balancer module of FIG. 20.

FIG. 24 is a front cross-sectional view of the driving part of the balancer module of FIG. 20.

MODE FOR THE INVENTION

Reference will now be made in detail to the embodiments of the present invention, examples of which are illustrated in the accompanying drawings.

FIG. 1 is a view schematically illustrating a structure of a washing machine in accordance with a first embodiment of the present invention. FIG. 2 is an exploded view of a structure of a rotating tub of the washing machine of FIG. 1. FIG. 3 is a view illustrating a structure of a front balancer of the washing machine of FIG. 1. FIG. 4 is a cross-sectional view of the front balancer of the washing machine of FIG. 1, in which an A portion of FIG. 1 is enlarged. FIG. 5 is a view for describing a structure of a balancer module of the washing machine of FIG. 1.

As illustrated in FIGS. 1 to 5, the washing machine 1 includes a cabinet 10 which forms an exterior thereof, a tub 20 which is disposed in the cabinet 10, a rotating tub 30 which is rotatably disposed in the tub 20, and a motor 40 which drives the rotating tub 30.

A laundry opening 11 is formed at a front surface of the cabinet 10 to put laundry into the rotating tub 30. The laundry opening 11 may be opened and closed by a door 12 installed at the front surface of the cabinet 10.

A water supplying pipe 50 which supplies wash water into the tub 20 may be provided above the tub 20. One side of the water supplying pipe 50 may be connected with an external water supply source (not shown), and the other side thereof may be connected with a detergent supplying unit 52.

The detergent supplying unit 52 may be connected with the tub 20 through a connection pipe 54. Water supplied through the water supplying pipe 50 may pass through the detergent supplying unit 52 and then may be supplied into the tub 20 with a detergent. A drain pump 60 and a drain pipe 62 which discharges the water in the tub 20 to an outside of the cabinet 10 may be installed at a lower portion of the tub 20.

The rotating tub 30 may include a cylindrical part 31, a front plate 32 which is disposed at a front portion of the cylindrical part 31, a rear plate 33 which is disposed at a rear portion of the cylindrical part 31, and a flange shaft 36 which is coupled to the rear plate 33 to transmit a driving force to the rotating tub 30. An opening 32*a* for entrance of the laundry is formed at the front plate 32.

A plurality of through-holes 34 through which the wash water passes are formed at a circumferential surface of the rotating tub 30, and a plurality of lifters 35 may be installed at an inner circumferential surface of the rotating tub 30 so that the laundry is moved up and then dropped, when the rotating tub 30 is rotated.

The flange shaft 36 includes at least one support leg 37 which extends outward in a radial direction to be coupled to the rear plate 33, and a rotating shaft 38 which has a hollow portion 39. The support leg 37 and the rotating shaft 38 may be integrally formed with each other.

The driving force of the motor 40 is transmitted to the flange shaft 36 via a driving pulley 40*a*, a belt 40*b*, and a driven pulley 40*c*. Serrated parts 40*d* and 38*a* (referring to FIG. 7) are provided at the driven pulley 40*c* and the flange shaft 36, respectively, and the driven pulley 40*c* and the flange shaft 36 are serration-coupled with each other. However, unlike the embodiment, the motor 40 may be directly connected with the flange shaft 36. That is, the motor 40 may include a fixed stator and a rotating rotor, and the flange shaft 36 may be directly connected to the rotor.

Here, the driven pulley 40*c* and the rotor may be power transmission units which are coupled to the flange shaft 36 to transmit the driving force.

In a washing process, the motor 40 may rotate the rotating tub 30 at a low speed in a forward or reverse direction, and thus the laundry in the rotating tub 30 is repeatedly moved up and dropped, and dirt may be removed from the laundry. In a spin-drying process, the motor 40 rotates the rotating tub 30 at a high speed in one direction, and thus the laundry may be spin-dried by a centrifugal force acting thereon.

During the spin-drying process, if the laundry is not uniformly distributed in the rotating tub 30, while the rotating tub 30 is rotated, the rotating tub 30 is unstably rotated, and thus vibration and noise are generated.

The washing machine 1 has balancers 400 and 700 which solve load unbalance of the rotating tub 30 and thus stably rotate the rotating tub 30. The balancers 400 and 700 may include a front balancer 400 which is installed at a front portion of the rotating tub 30, and a rear balancer 700 which is installed at a rear portion of the rotating tub 30.

The front balancer 400 and the rear balancer 700 are symmetrically configured. Therefore, only a structure of the front balancer 400 will be described, and the description of the rear balancer 700 will be omitted.

The balancer 400 is inserted into a balancer installation groove 32*b* which is formed at a rim in a circumferential direction. Although not illustrated, the balancer 400 inserted into the balancer installation groove 32*b* may be firmly coupled to the rotating tub 30 by a fastening member such as a screw.

The balancer 400 includes balancer housings 410 and 420 which have an annular channel 402, and balancer modules 500 and 600 which are movably disposed in the annular channel 402 of the balancer housings 410 and 420 to damp the load unbalance generated when the rotating tub 30 is rotated.

The balancer housings 410 and 420 may be formed by coupling a first housing 410 and a second housing 420. The first housing 410 may be formed in an approximately "⊏" shape. That is, the first housing 410 may include an external wall 412, an internal wall 414 which is formed to face the external wall 412 and disposed at an inner side of the rotating tub 30 than the external wall 412, and a connection wall 413 which connects the external wall 412 and the internal wall 414. An opening 411 is formed at an opposite side of the connection wall 413.

At this time, the connection wall 413 is disposed at an inner portion of the rotating tub 30 than the opening 411. Therefore, in the case of the front balancer 400, the connection wall 413 is disposed at a rear portion of the opening 411. In the case of the rear balancer 700, it is vice versa.

The external wall 412 may exchange a force with the balancer modules 500 and 600 by the centrifugal force, when the rotating tub 30 is rotated.

The second housing 420 is coupled to the opening 411 of the first housing 410 and forms the annular channel 402 with the first housing 410. The first housing 410 and the second housing 420 may be coupled in a thermal welding or the like.

The reason why the connection wall 413 of the first housing 410 having the approximately "⊏" shape is installed at the rotating tub 30 to be located at the inner side of the rotating tub 30 than the opening 411 is because it is advantageous to secure an inner space of the rotating tub 30, compared with an opposite case thereof.

That is, this is because a distance between the external wall 412 and the internal wall 414 is gradually increased from the connection wall 413 toward the opening 411 due to characteristics of a mold, when the first housing 410 having the approximately "⊏" shape is injection-molded.

The balancer modules 500 and 600 may be movably disposed in the annular channel 402 of the balancer housings 410 and 420. Here, since the balancer modules 500 and 600 have the same structure, only the balancer module 500 will be described, and the description of the balancer module 600 will be omitted.

The balancer module 500 includes a main plate 510 formed of a metallic material. The main plate 510 includes a central plate 520, and a plurality of side plates 530 and 540 which are formed at both sides of the central plate 520. The central plate 520 and each of the side plates 530 and 540 are bent at a predetermined angle θ.

A driving part 521 which moves the balancer module 500 is provided at the central plate 520. The driving part 521 includes a driving motor 522 and a driving wheel 523 which is rotated by a driving force of the driving motor 522.

Mass bodies 531 and 541 which damp an unbalanced load of the rotating tub 30, and bearings 532 and 542 which prevent a sliding of the balancer module 500 are provided at the side plates 530 and 540, respectively. In the embodiment, the bearings 532 and 542 are coupled to the side plates 530 and 540. However, the present invention is not limited thereto, and the bearings 532 and 542 may be directly coupled to the mass bodies 531 and 541.

A circuit board 533 which controls an operation of the balancer module 500 may be provided at the side plate 530, and a position discrimination part 543 which discriminates a position of the balancer module 500 may be provided at the side plate 540.

The main plate 510 may be provided to be elastically deformable, such that the angle between the central plate 520 and the side plates 530 and 540 is varied. The main plate 510 may be elastically deformed by the centrifugal force due to the rotation of the rotating tub 30.

That is, when the rotating tub 30 is rotated, the main plate 510 is elastically deformed so that the angle θ between the central plate 520 and the side plates 530 and 540 is increased by the centrifugal force acting on the mass bodies 531 and 541 provided at the side plates 530 and 540. When the rotating tub 30 is stopped and thus the centrifugal force acting on the mass bodies 531 and 541 provided at the side plates 530 and 540 is released, the main plate 510 is returned to its original state by an elastic force.

Electrodes 810 and 820 are provided at the balancer housings 410 and 420 in a circumferential direction so as to supply electric power to the balancer modules 500 and 600. The electrodes 810 and 820 may be provided at the connection wall 413 of the balancer housings 410 and 420. The electrodes 810 and 820 may be continuously provided at an inner surface of the connection wall 413 of the balancer housings 410 and 420 in the circumferential direction of the balancer housings 410 and 420.

The balancer modules 500 and 600 includes an electrode contact terminal (not shown) which is in contact with the electrodes 810 and 820, and the electrode contact terminal of the balancer modules 500 and 600 is in contact with the electrodes 810 and 820, and thus the electric power may be supplied.

The washing machine 1 includes a power supplying unit 960 (referring to FIG. 6) which generates the electric power necessary for the operation of the balancer modules 500 and 600, and wires 121 and 970 which electrically connect the power supplying unit 960 and the electrodes 810 and 820 of the balancer housings 410 and 420 so as to supply the electric power produced from the power supplying unit 960 to the electrodes 810 and 820 of the balancer housings 410 and 420.

The power supplying unit 960 may include a circuit unit which produces output power from input power. The power supplying unit 960 may include a voltage-controlled semiconductor device or a current-controlled semiconductor device. The power supplying unit 960 may include a printed circuit board on which various electronic devices are mounted. The power supplying unit 960 may be provided at an outside of the tub 20.

The wires 121 and 970 include all kinds of wires which transmit the electric power. The wires 121 and 970 may be formed by bare wires formed of copper, aluminum, steel, silver, or the like and coated with an insulating material.

According to the embodiment of the present invention, since one ends of the wires 121 and 970 are connected with the electrodes of the balancer housings 410 and 420, the wires 121 and 970 may be twisted, when the rotating tub 30 is rotated. The washing machine 1 in accordance with the embodiment of the present invention includes a slip ring 900 which prevents a twist of the wires 121 and 970.

The wires 121 and 970 may include an external wire 970 (referring to FIG. 6) which connects the power supplying unit 960 and the slip ring 900, and an internal wire 121 (referring to 1) which connects the slip ring 900 and the electrodes 810 and 820 of the balancer housings 410 and 420.

The internal wire 121 which is moved according to the rotation of the rotating tub 30, and the fixed external wire 970 may be electrically connected with each other through the slip ring 900 without the twist.

The internal wire 121 passes through the hollow portion 39 of the rotating shaft 38 of the flange shaft 36, and the lifter 35 at the inner circumferential surface of the rotating tub 30 so as to electrically connect the slip ring 900 and the balancer housings 410 and 420. Therefore, the wash water is prevented from permeating the internal wire 121.

FIG. 6 is a view illustrating a lower surface of the tub of the washing machine of FIG. 1. FIG. 7 is a view for describing a coupling relationship of the slip ring of the washing machine of FIG. 1. FIG. 8 is a cross-sectional view illustrating the slip ring of the washing machine of FIG. 1. FIG. 9 is a view illustrating a waterproofing structure of a waterproofing tube and the flange shaft of the washing machine of FIG. 1. FIG. 10 is a view illustrating a stopper member and the flange shaft of the washing machine of FIG. 1. FIG. 11 is a view illustrating a waterproofing structure of the waterproofing tube and the balancer of the washing machine of FIG. 1.

Referring to FIGS. 6 to 11, the slip ring 900 of the washing machine in accordance with the embodiment of the present invention is coupled with a fastening member 940 coupled to an end 38*b* (referring to FIG. 7) of the rotating shaft 38 of the flange shaft 36.

Here, the fastening member 940 serves to allow the rotating shaft 38 of the flange shaft 36 to be firmly coupled to the driven pulley 40*c*. That is, the fastening member 940 supports the driven pulley 40*c* and thus prevents the driven pulley 40*c* from being separated from the flange shaft 36. The fastening member 940 is rotated with the flange shaft 36 and the driven pulley 40*c*.

The fastening member 940 includes a nut. That is, the fastening member 940 may be formed of an approximately cylindrical shape having a hollow portion. A female screw may be formed at an inner circumferential surface 941 of the fastening member 940, and a male screw may be correspondingly formed at the rotating shaft 38 of the flange shaft 36. An outer circumferential surface 942 of the fastening member 940 may have a polygonal shape.

The slip ring 900 includes a rotating part 910 (referring to FIG. 8) which is rotated with the rotating tub 30, when the motor 40 is operated, and a body part 920 (referring to FIG. 8) which is coupled to an outer side of the rotating part 910.

The rotating part 910 may have an internal terminal portion 911 to which the internal wire 121 is connected, and the body part 920 may have an external terminal portion 922 to which the external wire 970 is connected. One pair of the internal terminal portion 911 and the external terminal portion 922 may be provided to be connected with a positive pole and a negative pole, respectively.

A brush 921 which is in contact with the internal terminal portion 911 and the external terminal portion 922 is provided between the internal terminal portion 911 and the external terminal portion 922, such that the internal terminal portion 911 and the external terminal portion 922 are always electrically connected with each other, regardless of a rotating of the rotating part 910.

A bearing 930 is provided between the rotating part 910 and the body part 920 to couple the rotating part 910 with the body part 920 and also to rotatably support the rotating part 910. The bearing 930 may be a ball-and-roller bearing which has an inner wheel, an outer wheel, and balls.

The rotating part 910 may be coupled to the outer circumferential surface of the fastening member 940 in a manner in which the rotating part 910 has a hollow portion which accommodates the fastening member 940, and the fastening member 940 is inserted into the hollow portion of the rotating part 910.

As described above, since the rotating part 910 of the slip ring 900 is coupled to the outer circumferential surface 942 of the fastening member 940, and the body part 920 is provided at the outside of the rotating part 910 in a radial direction, the slip ring 900 may have a short axial length. Therefore, a large space for installing the slip ring 900 between the tub 20 and the cabinet 10 is not required, and thus it is possible to minimize a reduction of a volume of the rotating tub 30 due to an installation of the slip ring 900.

The washing machine 1 may have a guide bracket 950 which guides and protects the external wire 970 so that the external wire 970 connecting the slip ring 900 and the power supplying unit 960 is neatly arranged without being twisted.

One end of the guide bracket 950 may be coupled to the body part 920, and the other end thereof may be coupled to the tub 20 or the cabinet 10.

The guide bracket 950 may have an approximately bent rod shape or straight rod shape. A first coupling part 951 which is coupled to the body part 920 of the slip ring 900 may be provided at one end of the guide bracket 950, and a second coupling part 953 which is coupled to the tub 20 may be provided at the other end thereof.

The first coupling part 951 may be coupled to the body part 920 of the slip ring 900 through a fastening member such as a screw. To this end, the first coupling part 951 may include a fastening hole in which the fastening member is coupled.

The second coupling part 953 may be coupled to the tub 20 or the cabinet 10 through a fastening member. To this end, the second coupling part 953 may include a fastening hole in which the fastening member is coupled.

The guide bracket 950 may include a wire path 952 which guides the external wire 970 electrically connecting the slip ring 900 and the power supplying unit 960. The wire path 952 of the guide bracket 950 may accommodate the external wire 970.

The guide bracket 950 may serve to guide and protect the external wire 970 and also to restrict a movement of the slip ring 900.

Since the body part 920 of the slip ring 900 is coupled to the rotating part 910 of the slip ring 900 via the bearing 930, and thus the body part 920 may be rotated together when the rotating part 910 is rotated, the guide bracket 950 connects the body part 920 with the tub 20 or the cabinet 10, such that the body part 920 is prevented from being rotated.

Meanwhile, the washing machine in accordance with the embodiment of the present invention may include a waterproofing tube 130 which sealingly accommodates the internal wire 121 to fundamentally prevent the wash water from permeating the internal wire 121. The waterproofing tube 130 may be formed of a material having air-tightness, and one end of the waterproofing tube 130 may be coupled to the rotating shaft 38 of the flange shaft 36, and the other end thereof may be coupled to the balancer housings 410 and 420.

To maintain the air-tightness between the waterproofing tube 130 and the hollow portion 39 of the rotating shaft 38 of the flange shaft 36, the washing machine may further include a stopper member 150 which is coupled into the hollow portion 39 of the rotating shaft 38 of the flange shaft 36.

The stopper member 150 includes a shaft coupling part 151 which protrudes so as to be inserted into the hollow portion 39 of the rotating shaft 38 of the flange shaft 36, and at least one tube coupling part 152 which protrudes so that one end of the waterproofing tube 130 is coupled thereto. A path through which the internal wire 121 passes is formed at an inner side of the stopper member 150.

A male screw may be provided at the shaft coupling part 151 of the stopper member 150, and a female screw may be provided at the hollow portion 39 of the rotating shaft 38 of the flange shaft 36, and thus the shaft coupling part 151 of the stopper member 150 may be firmly screwed into the hollow portion 39 of the rotating shaft 38 of the flange shaft 36. Also, an O-ring-shaped sealing member 160 which maintains the air-tightness may be provided between the stopper member 150 and the hollow portion 39 of the rotating shaft 38 of the flange shaft 36.

A clip member 140 may be bound to the waterproofing tube 130 so as to fix the waterproofing tube 130 coupled to the tube coupling part 152 of the stopper member 150 and also to allow the waterproofing tube 130 to be in close contact with the tube coupling part 152. A shape and a material of the clip member 140 are not limited, as long as the clip member 140 may bind and fix the waterproofing tube 130 and may allow the waterproofing tube 130 to be in close contact with the tube coupling part 152 of the stopper member 150, thereby maintaining the air-tightness.

As described above, the stopper member 150 is coupled into the hollow portion 39 of the rotating shaft 38 of the flange shaft 36, and thus the stopper member 150 may protrude toward the rear plate 33 of the rotating tub 30. Therefore, a stopper member accommodating part 33*a* (referring to FIG. 2) which protrudes in the form of a semi-spherical shape may be formed at the rear plate 33 of the rotating tub 30 so as to accommodate the stopper member 150 and also to minimize the reduction of the internal volume of the rotating tub 30.

Meanwhile, as illustrated in FIG. 11, the other end of the waterproofing tube 130 of which one end is coupled into the hollow portion 39 of the rotating shaft 38 of the flange shaft 36 is coupled to at least one of the balancer housings 410 and 420. In particular, the waterproofing tube 130 coupled to the balancer housings 410 and 420 of the front balancer 400 may be disposed to pass through the lifter 35 provided at the inner surface of the rotating tub 30.

A tube coupling part 415 may protrude from the balancer housings 410 and 420 so that the waterproofing tube 130 is coupled thereto. Also, the clip member 140 may be bound to the waterproofing tube 130 of the side of the tube coupling part 415 so as to fix the waterproofing tube 130 and also to allow the waterproofing tube 130 to be in close contact with the tube coupling part 415.

FIG. 12 is a view schematically illustrating a structure of a washing machine in accordance with a second embodiment of the present invention. FIG. 13 is a perspective view of a lower surface of a tub of the washing machine of FIG. 12. FIG. 14 is a cross-sectional view illustrating a coupling structure of a flange shaft, a slip ring, and a guide bracket of the washing machine of FIG. 12. FIG. 15 is a cross-sectional view enlargedly illustrating the coupling structure of the flange shaft and the slip ring of the washing machine of FIG. 12. FIG. 16 is an exploded view illustrating a packing member, a clamp ring, and a fastening member coupled to the flange shaft of the washing machine of FIG. 12 (wherein the slip ring is omitted). FIG. 17 is a view illustrating the packing member sealing a hollow portion of the flange shaft of the washing machine of FIG. 12, in which the packing member is in an opened state (wherein the slip ring is omitted). FIG. 18 is a view illustrating the packing member sealing the hollow portion of the flange shaft of the washing machine of FIG. 12, in which the packing member is in a closed state (wherein the slip ring is omitted). FIG. 19 is an enlarged view illustrating a spacing structure of the guide bracket of the washing machine of FIG. 12.

A washing machine in accordance with a second embodiment of the present invention will be described with reference to FIGS. 12 to 19. The same components as those of the first embodiment are designated by the same reference numerals, and repeated description thereof will be omitted.

The washing machine may have a directly connected power transmission structure in which a motor 1040 is directly connected to the rotating shaft 38 of the flange shaft 36.

The motor 1040 includes a fixed stator 1041, and a rotor 1042 which electromagnetically interacts with the stator 1041 to be rotated. The rotor 1042 may be disposed at an outside of the stator 1041. However, unlike the embodiment, the rotor 1042 may be disposed at an inside of the stator 1041.

The serrated part 38*a* (referring to FIG. 7) may be provided at the rotating shaft 38 of the flange shaft 36, and also the serrated part (not shown) may be provided at the rotor 1042, such that the rotating shaft 38 of the flange shaft 36 and the rotor 1042 may be serration-coupled with each other to exchange the force with each other.

The fastening member 940 (referring to FIG. 16) is coupled to an end of the flange shaft 36 so that the rotor 1042 is firmly coupled to the rotating shaft 38 of the flange shaft 36. The fastening member 940 supports the rotor 1042, and prevents the rotor 1042 from being separated from the rotating shaft 38 of the flange shaft 36. The fastening member 940 is rotated with the rotor 1042 and the flange shaft 36.

The fastening member 940 includes a nut. That is, the fastening member 940 may be formed of the approximately cylindrical shape having a hollow portion and the female screw may be formed at the inner circumferential surface 941 of the fastening member 940. The outer circumferential surface 942 of the fastening member 940 may have the polygonal shape. The fastening member 940 may have a support part 943 which is in close contact with the rotor 1042 so as to support the rotor 1042.

As illustrated in FIG. 15, a slip ring 1900 includes a rotating part 1910 which is coupled to the outer circumferential surface 942 of the fastening member 940 so as to be rotated together, when the fastening member 940 is rotated, and a body part 1920 which is provided at an outer side of the rotating part 1910.

The rotating part 1910 includes a side support portion 1912 which supports the outer circumferential surface 942 of the fastening member 940, and an interference portion 1913 which is interfered with a clamp ring 1980. The interference portion 1913 of the rotating part 1910 is interfered with the clamp ring 1980, and thus the slip ring 1900 may be prevented from being separated from the rotating shaft 38 of the flange shaft 36.

The clamp ring 1980 is coupled to an end of the rotating shaft 38 of the flange shaft 36. To this end, a clamp groove 38*c* to which the clamp ring 1980 is coupled may be formed at an outer circumferential surface of the rotating shaft 38 of the flange shaft 36.

The rotating part 1910 may have an internal terminal portion 1911 to which the internal wire 121 is connected, and the body part 1920 may have an external terminal portion 1922 to which the external wire 970 is connected. One pair of the internal terminal portion 1911 and the external terminal portion 1922 may be provided to be connected with the positive pole and the negative pole, respectively.

A brush 1921 which is in contact with the internal terminal portion 1911 and the external terminal portion 1922 is provided between the internal terminal portion 1911 and the external terminal portion 1922, such that the internal terminal portion 1911 and the external terminal portion 1922 are always electrically connected with each other, regardless of a rotating of the rotating part 1910.

A bearing 1930 is provided between the rotating part 1910 and the body part 1920 to couple the rotating part 1910 with the body part 1920 and also to rotatably support the rotating part 1910.

The body part 1920 may be formed in an approximately cylindrical shape, and may be formed so that an upper surface thereof is opened for a connection operation of the wire 121 or the like.

A packing member 1990 which prevents moisture from permeating the hollow portion 39 of the rotating shaft 38 of the flange shaft 36 may be coupled to the rotating shaft 38 of the flange shaft 36. The packing member 1990 may seal the hollow portion 39 of the rotating shaft 38 of the flange shaft 36. To this end, the packing member 1990 may be formed of a rubber material having sealability.

The packing member 1990 may be formed by coupling a female packing part 1991 which is inserted into and in close contact with the hollow portion 39 of the rotating shaft 38 of the flange shaft 36 and a male packing part 1996 which is inserted into and in close contact with a hollow portion 1994 of the female packing part 1991.

The female packing part 1991 may include a packing body portion 1992 having the hollow portion 1994, and a packing flange portion 1993 which extends from the packing body portion 1992 toward an outside in a radial direction. The packing body portion 1992 may be in close contact with an inner circumferential surface of the hollow portion 39 of the rotating shaft 38 of the flange shaft 36. The packing body portion 1992 may have a cylindrical shape having the hollow portion 1994.

The male packing part 1996 may include a packing insertion portion 1997 which is inserted into and in close contact with the hollow portion 1994 of the packing body portion 1992, and a packing cover portion 1998 which extends from the packing insertion portion 1997 toward an outside in a radial direction so as to be in close contact with the packing flange portion 1993.

The female packing part 1991 and the male packing part 1996 may be connected by a connection strip part 1999. The connection strip part 1999 may be formed to be flexible. The female packing part 1991 and the male packing part 1996 may be connected through the connection strip part 1999, and thus the packing member 1990 may be formed integrally. However, unlike the embodiment, the connection strip part 1999 may be omitted, and the female packing part 1991 and the male packing part 1996 may be formed separately.

A guide groove 1993*a* which guides the internal wire 121 may be formed at the packing flange portion 1993 of the female packing part 1991. The internal wire 121 may come out along the guide groove 1993*a* from the hollow portion 39 of the rotating shaft 38 of the flange shaft 36.

A washing machine 1001 may have a guide bracket 1950 which guides and protects the external wire 970 so that the external wire 970 is neatly arranged without being twisted.

The guide bracket 1950 may connect the slip ring 1900 and the tub 20. However, unlike the embodiment, the guide bracket 1950 may connect the slip ring 1900 and the cabinet 10.

The guide bracket 1950 may serve to guide and protect the external wire 970 and also to restrict a movement of the slip ring 1900.

Since the body part 1920 of the slip ring 1900 is coupled to the rotating part 1910 of the slip ring 1900 via the bearing 1930, and thus the body part 1920 may be rotated together when the rotating part 1910 is rotated, the guide bracket 1950 connects the body part 1920 with the tub 20 or the cabinet 10, such that the body part 1920 is prevented from being rotated.

However, when the body part 1920 is violently rotated, a great load may act on the guide bracket 1950, and thus the guide bracket 1950 may be bent or broken.

To prevent the guide bracket 1950 from being damaged, the guide bracket 1950 may include a first bracket 1951 which is coupled to the body part 1920 of the slip ring 1900, and a second bracket 1955 which is coupled to the tub 20 or the cabinet 10, and the first bracket 1951 and the second bracket 1955 may be provided separately.

The first bracket 1951 and the second bracket 1955 may respectively have wire paths 1952 and 1956 which guide the external wire 970. The wire paths 1952 and 1956 may accommodate the external wire 970. An end of the first bracket 1951 may be disposed in the wire path 1956 of the second bracket 1955.

The second bracket 1955 may have a rotation preventing wall 1957 which is interfered with the end of the first bracket 1951 so as to prevent the body part 1920 of the slip ring 1900 from being rotated together, when the rotating part 1910 of the slip ring 1900 is rotated.

The rotation preventing wall 1957 may be provided at left and right sides of the end of the first bracket 1951 to have a predetermined gap, and thus may restrict a rotating range of the first bracket 1951 in forward and reverse directions.

FIG. 20 is a view illustrating a balancer module in accordance with another embodiment of the present invention. FIG. 21 is a bottom perspective view of a driving part of the balancer module of FIG. 20. FIG. 22 is a side view of the driving part of the balancer module of FIG. 20. FIG. 23 is a side cross-sectional view of the driving part of the balancer module of FIG. 20. FIG. 24 is a front cross-sectional view of the driving part of the balancer module of FIG. 20.

A balancer module 2000 includes a main plate 2010 which is elastically deformable. The main plate 2010 includes a central plate 2011, and a plurality of side plates 2012 and 2013 which are formed at both sides of the central plate 2011 so as to be bent at a predetermined angle θ with respect to the central plate 2011.

Mass bodies 2100 may be installed at the side plates 2012 and 2013, respectively. A circuit board 2200 which controls a driving part 2020 may be installed at one of the mass bodies 2100. Various devices which operate the driving part 2020 are mounted on the circuit board 2200.

A position discrimination part 2300 may be installed at the other one of the mass bodies 2100. The position discrimination part 2300 may be a magnetic body including a permanent magnet, a light emitting part which emits light, or a reflecting plate which reflects emitted light. The position discrimination part 2300 serves to allow position discrimination of the balancer module 2000.

Bearings 2500 which prevent a sliding of the balancer module 2000 may be coupled to the side plates 2012 and 2013, respectively. Unlike this, the bearings 2500 may be installed at the mass bodies 2100.

The driving part 2020 is provided at the central plate 2011. The driving part 2020 includes a driving motor 2030 which generates a driving force, a driving wheel 2040 which is grounded to the balancer housings 410 and 420 (referring to FIG. 3) to be rotated, and a driving part housing 2050.

The driving wheel 2040 may be grounded to the external wall 412 (referring to FIG. 4) of the balancer housings 410 and 420 to be rotated. When the driving wheel 2040 is rotated, the driving wheel 2040 may be rolled by a friction force between the driving wheel 2040 and the external wall 412 of the balancer housings 410 and 420.

The driving wheel 2040 may include an inner wheel 2040*a* (referring to FIG. 24) which is provided at an inside in a radial direction to be fixed to a rotating shaft 2041 of the driving wheel 2040, and an outer wheel 2040*b* (referring to FIG. 24) which is coupled to an outside in the radial direction to be grounded to the external wall 412 of the balancer housings 410 and 420.

The outer wheel 2040*b* may be formed of a rubber material which has elasticity to secure a friction force with the external wall 412 of the balancer housings 410 and 420.

Therefore, the driving wheel 2040 may be elastically deformed to be compressed, as a rotating speed of the balancer module 2000 is increased. This is because, when the rotating speed of the balancer module 2000 is increased, a centrifugal force acting on the balancer module 2000 is increased, and thus a force acting on the driving wheel 2040 from the external wall 412 of the balancer housings 410 and 420 is increased. When the rotating speed of the balancer module 2000 is reduced, the driving wheel 2040 may be returned to its original state.

The driving force of the driving motor 2030 may be transmitted to the driving wheel 2040 through worm gears 2032 and 2042 (referring to FIG. 23). That is, a rotating shaft 2031 of the driving motor 2030 may be provided vertically to the rotating shaft 2041 of the driving wheel 2040, a worm 2032 may be formed at the rotating shaft 2031 of the driving motor 2030, and a worm wheel 2042 (transmission gear) engaged with the worm 2032 may be formed at the rotating shaft 2041 of the driving wheel 2040.

Therefore, when the driving motor 2030 is driven, and the rotating shaft 2031 of the driving motor 2030 is rotated, the rotating force is transmitted to the rotating shaft 2041 of the driving wheel 2040 by engagement between the worm 2032 and the worm wheel 2042, and thus the driving wheel 2040 may be rotated.

Both of the worm wheel 2042 and the driving wheel 2040 are rotated about the rotating shaft 2041 of the driving wheel 2040, and a radius R1 (referring to FIG. 24) of the worm wheel 2042 is formed to be smaller than that R2 (referring to FIG. 24) of the driving wheel 2040.

The driving motor 2030 may be accommodated in the driving part housing 2050. The driving part housing 2050 may have an approximately box shape, and may include a front wall 2051, a rear wall 2052, side walls 2053 and 2054, a bottom wall 2055, and an upper wall 2056. Like this, since the driving motor 2030 is accommodated and protected in the driving part housing 2050, the driving motor 2030 may be prevented from colliding with the balancer housings 410 and 420 while the balancer module 2000 is driven.

Since the driving wheel 2040 should be grounded to the balancer housings 410 and 420, an opening 2055*a* may be formed at the bottom wall 2055 of the driving part housing 2050 so that the driving wheel 2040 is exposed to an outside of the driving part housing 2050.

Meanwhile, as described above, the driving wheel 2040 is provided to be elastically deformed and compressed depending on the movement of the balancer module 2000, and thus when the balancer module 2000 is moved at a high speed, the driving wheel 2040 may be compressed so that the radius R2 of the driving wheel 2040 is smaller than the radius R1 of the worm wheel 2042.

In this case, the worm wheel 2042 is directly in contact with the balancer housings 410 and 420, and the worm wheel 2042 or the driving motor 2030 may be damaged, or the worm wheel 2042 and the worm 2032 may be separated. Therefore, the driving part 2020 may include a contact preventing part 2060 which prevents the worm wheel 2042 from being directly in contact with the balancer housings 410 and 420. The driving part housing 2050 may include the contact preventing part 2060.

The contact preventing part 2060 may protrude downward from the driving part housing 2050. The contact preventing part 2060 may have an arc shape which protrudes toward the external wall 412 of the balancer housings 410 and 420.

The contact preventing part 2060 may have a contact surface 2061 (referring to FIG. 24) which is in contact with the external wall 412 of the balancer housings 410 and 420, when the driving wheel 2040 is elastically deformed and compressed.

When the driving wheel 2040 is elastically deformed and compressed, the contact surface 2061 should be in contact with the external wall 412 of the balancer housings 410 and 420 earlier than the worm wheel 2042. To this end, a distance L (referring to FIG. 24) between the contact surface 2061 and the rotating shaft 2041 of the driving wheel 2040 is provided to be greater than the radius R1 of the worm wheel 2042 but smaller than the radius R2 of the driving wheel 2040.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A washing machine comprising:

a cabinet;

a rotating tub disposed in the cabinet to accommodate laundry;

a flange shaft coupled to a rear surface of the rotating tub to transmit a driving force to the rotating tub and comprising a rotating shaft in which a hollow portion is formed, the hollow portion penetrating the flange shaft so as to be opened toward the rear surface of the rotating tub;

at least one balancer housing having an annular channel formed therein and installed at the rotating tub;

at least one balancer module movably disposed in the annular channel of the at least one balancer housing to damp load unbalance when the rotating tub is rotated;

a wire configured to pass through the hollow portion of the flange shaft to supply electric power to the at least one balancer module and connected with the at least one balancer housing; and a waterproofing tube provided between the flange shaft and the at least one balancer housing to prevent wash water from permeating the wire and to sealingly accommodate the wire.

2. The washing machine according to claim 1, further comprising a stopper member coupled into the hollow portion of the flange shaft so that one end of the waterproofing tube is coupled thereto.

3. The washing machine according to claim 2, wherein the stopper member comprises a shaft coupling part configured to protrude so as to be inserted into the hollow portion of the flange shaft, and at least one tube coupling part configured so that the one end of the waterproofing tube is coupled thereto.

4. The washing machine according to claim 3, wherein a male screw is formed at an outer circumferential surface of the shaft coupling part, and a female screw screwed to the male screw is formed at the hollow portion of the flange shaft.

5. The washing machine according to claim 2, further comprising a sealing member provided between the stopper member and the flange shaft to seal the stopper member and the hollow portion of the flange shaft.

6. The washing machine according to claim 3, further comprising a clip member provided to bind the waterproofing tube so that the tube coupling part of the stopper member and the waterproofing tube are in close contact with each other.

7. The washing machine according to claim 2, wherein a stopper member accommodating part configured to accommodate the stopper member is formed at a rear plate of the rotating tub.

8. The washing machine according to claim 1, wherein the at least one balancer housing comprises a tube coupling part which protrudes so that one end of the waterproofing tube is coupled thereto.

9. The washing machine according to claim 8, further comprising a clip member provided to bind the waterproofing tube so that the tube coupling part of the at least one balancer housing and the waterproofing tube are in close contact with each other.

10. The washing machine according to claim 1, wherein the rotating tub comprises a lifter provided at an inner circumferential surface thereof to move up the laundry, and the waterproofing tube is disposed to pass through the lifter.

11. A washing machine comprising:

a cabinet;

a rotating tub disposed in the cabinet to accommodate laundry;

a flange shaft coupled to a rear surface of the rotating tub to transmit a driving force to the rotating tub and comprising a rotating shaft in which a hollow portion is formed, the hollow portion penetrating the flange shaft so as to be opened toward the rear surface of the rotating tub;

at least one balancer housing having an annular channel formed therein and installed at the rotating tub;

at least one balancer module movably disposed in the annular channel of the at least one balancer housing to damp load unbalance when the rotating tub is rotated;

a power supplying unit configured to generate electric power for driving the at least one balancer module;

a wire configured to pass through the rotating shaft of the flange shaft to supply the electric power to the at least one balancer module and configured to electrically connect the power supplying unit and the at least one balancer housing; and a slip ring provided at an end of the rotating shaft of the flange shaft to prevent the wire from being twisted by rotation of the rotating tub.

12. The washing machine according to claim 11, further comprising a power transmission unit coupled to the flange shaft so as to transmit the driving force to the flange shaft, and a fastening member coupled to an end of the flange shaft to support the power transmission unit, and wherein the slip ring is coupled to an outside of the fastening member.

13. The washing machine according to claim 11, wherein the slip ring comprises a body part to which an external wire connected with the power supplying unit is connected, and a rotating part to which an internal wire connected with the at least one balancer housing is connected and which is rotated with the flange shaft.

14. The washing machine according to claim 11, further comprising a clamp ring coupled to the rotating shaft of the flange shaft to prevent the slip ring from being separated from the rotating shaft of the flange shaft.

15. The washing machine according to claim 11, further comprising a packing member coupled to the rotating shaft of the flange shaft to seal the hollow portion of the rotating shaft of the flange shaft and thus to prevent moisture from permeating the hollow portion of the rotating shaft of the flange shaft.

16. The washing machine according to claim 15, wherein the packing member comprises a female packing part inserted into and in close contact with the hollow portion of the rotating shaft of the flange shaft, and a male packing part inserted into and in close contact with the female packing part.

17. The washing machine according to claim 16, wherein the female packing part comprises a packing body portion having a hollow portion, and a packing flange portion configured to extend from the packing body portion toward an outside in a radial direction, and the male packing part comprises a packing insertion portion inserted into and in close contact with the hollow portion of the packing body portion, and a packing cover portion configured to extend from the packing insertion portion toward an outside in a radial direction so as to be in close contact with the packing flange portion.

18. The washing machine according to claim 13, further comprising a guide bracket configured to connect the slip ring with the rotating tub or the cabinet so as to guide the external wire and to restrict a movement of the slip ring.

19. The washing machine according to claim 18, wherein the guide bracket comprises a first coupling part formed at one end thereof to be coupled with the body part of the slip ring, a second coupling part formed at another end thereof to be coupled with the rotating tub or the cabinet, and a wire path configured to accommodate the external wire.

20. The washing machine according to claim 18, wherein the guide bracket comprises a first bracket coupled to the body part of the slip ring, and a second bracket coupled to the rotating tub or the cabinet and separated from the first bracket, wherein the second bracket comprises a rotation preventing wall interfered with the first bracket so as to restrict a rotating range of the first bracket when the rotating tub is rotated.

* * * * *